US012256815B2

(12) United States Patent
Kocak

(10) Patent No.: US 12,256,815 B2
(45) Date of Patent: Mar. 25, 2025

(54) ROTATING JEWELRY CLOSURE

(71) Applicant: Empire Casting House, Inc., New York, NY (US)

(72) Inventor: John Kocak, Cliffside Park, NJ (US)

(73) Assignee: Empire Casting House, Inc., New York, NY (US)

( * ) Notice: Subject to any disclaimer, the term of this patent is extended or adjusted under 35 U.S.C. 154(b) by 0 days.

(21) Appl. No.: 18/101,480

(22) Filed: Jan. 25, 2023

(65) Prior Publication Data

US 2024/0324738 A1 Oct. 3, 2024

(51) Int. Cl.
*A44C 5/20* (2006.01)

(52) U.S. Cl.
CPC ..... *A44C 5/2057* (2013.01)

(58) Field of Classification Search
CPC ..... A44C 5/2057; A44C 5/185; A44C 5/2076; A44C 5/208; A44C 5/209; A44C 15/005; A44B 11/2542; A44B 11/2553; A44B 11/2588
See application file for complete search history.

(56) References Cited

U.S. PATENT DOCUMENTS 1,504,761 A * 8/1924 Hubbell ..... A44C 5/2076 24/116 R
4,246,679 A * 1/1981 Monett ..... A44C 5/2076 24/574.1
5,311,647 A * 5/1994 Levy ..... A44C 5/208 24/616
5,317,789 A * 6/1994 Levy ..... A44C 5/208 24/616
6,003,213 A * 12/1999 Keller ..... A44C 5/2057 24/615
6,298,526 B1 * 10/2001 Baumdicker ..... A44B 99/00 24/716
6,508,080 B1 * 1/2003 Ninomiya ..... A44C 5/2042 63/3.1
8,079,117 B2 * 12/2011 Pontaoe ..... A44B 11/2534 24/615
8,904,821 B1 * 12/2014 DiPietro ..... A44C 5/2057 63/3.1
9,326,569 B1 * 5/2016 Cipolla ..... A44C 5/2076
9,943,142 B1 * 4/2018 Thomsen ..... A44B 17/0076
10,729,106 B2 * 8/2020 McConnell ..... A01K 27/005
11,470,923 B1 * 10/2022 Nikolla ..... A44B 99/005
(Continued)

*Primary Examiner* — Jason W San
*Assistant Examiner* — Anna S Rashid
(74) *Attorney, Agent, or Firm* — Sofer & Haroun, LLP

(57) ABSTRACT

A jewelry item has a first side including a first and second end with a stem and locking notch and a second side including a third and fourth end with a mounting stem and ball joint. The second end of the first side is connected to the fourth end of the second side. A closure has a collar rotatably connected to a rotatable connection element. The collar is connected to the third end and located between the third end and the rotatable connection element. In an open configuration, the stem with the locking notch of the first side can be inserted within a locking cavity of the rotatable connection element. In a closed configuration, the rotatable connection element is configured to be rotated to engage the locking notch of the stem, preventing removal of the stem from the rotatable connection element.

8 Claims, 6 Drawing Sheets

(56) References Cited

U.S. PATENT DOCUMENTS 11,737,527 B2 * 8/2023 Duncan ..... H01F 7/0263 63/3.1
2002/0174681 A1 * 11/2002 Godsey ..... A44C 15/0035 63/3.1
2002/0184914 A1 * 12/2002 Vanasse ..... A44C 5/20 63/3.1
2004/0011079 A1 * 1/2004 Rose ..... A44C 17/0208 63/29.1
2006/0021381 A1 * 2/2006 Richardson ..... A44C 5/209 63/3.1
2008/0141502 A1 * 6/2008 Khubani ..... A44C 5/208 24/303
2008/0256978 A1 * 10/2008 Chan ..... A44C 5/2076 63/3.1
2008/0271296 A1 * 11/2008 Jepsen ..... A44C 5/2076 63/21
2009/0013720 A1 * 1/2009 Altick ..... A44C 5/2076 63/3.1
2009/0241596 A1 * 10/2009 Fulkerson ..... A44C 5/208 63/3.1
2010/0122554 A1 * 5/2010 Bak ..... A44C 7/00 63/12
2011/0258816 A1 * 10/2011 Hashimoto ..... A44C 7/003 24/303
2011/0289740 A1 * 12/2011 Yakubovich ..... A44C 5/2033 24/574.1
2013/0036597 A1 * 2/2013 Parng ..... H04R 1/1058 156/60
2015/0047156 A1 * 2/2015 Ninomiya ..... A44C 5/2057 24/595.1
2016/0306393 A1 * 10/2016 Huitema ..... G06F 1/1643
2019/0029374 A1 * 1/2019 Goldberg ..... A44C 17/0241
2019/0107174 A1 * 4/2019 Sullivan ..... A44B 11/2546
2019/0249458 A1 * 8/2019 Lin ..... E05B 17/20
2022/0148414 A1 * 5/2022 Mruk ..... H04W 4/90
2022/0192286 A1 * 6/2022 Spence ..... A41D 13/0556
2024/0000203 A1 * 1/2024 Da Rocha Valente ..... A44C 5/2057
2024/0016262 A1 * 1/2024 Jensen ..... A44C 5/2066

* cited by examiner

ROTATING JEWELRY CLOSURE

FIELD OF THE INVENTION

This application relates to the field of jewelry. More particularly, the present application relates to the field of jewelry closures of connection elements.

BACKGROUND

In the field of jewelry, particularly with earrings, bracelets and necklaces, there are many types of closures or backings that are used in the prior art. For example, with earrings, the most common type of backing is the push-back which has a friction end stopper that is placed on the stem after it pressed through the piercing. These push-backs can come in many forms such as a butterfly shape, bell, or disc end-stopper. A drawback with this type of closure is that in some cases it is hard to fit the closure onto the stem, and also such independent push-backs are often lost or misplaced.

Another type of earing closure is the kidney closing which can take the shape of the stem extending an elongated loop that closes by latching the end behind a small hook. Here a pendant can hang on the kidney-closing and kept in place by a recess, but if left open the pendant can slide out of the closure. Another open stem closing is the fishhook closing which looks essentially similar to a fishing hook. Where the kidney closure is a closed-loop when closed, a fishhook type is somewhat similar but is always be open and could potentially result in the earing falling out.

Another earing closure is the endless closure where a post extends from one end of a hoop and, after passing through the piercing, enters a cavity on the other side of the hoop, making an apparently seamless hoop. This provides a very streamlined closure, but it can be hard to fit the post into the small opening on the other side of the hoop.

There are other common earring closures for non-pierced ears such a clip-on closures or friction closures, but they are not applicable to pierced earring closures.

Regarding closures for larger jewelry items such as bracelets or necklaces, there are numerous other known closures. A first type of common closure is a ball or bead clasp, which is a round, spherical jewelry fastener. Another common clasp is the barrel clasp which is small barrel or torpedo-shaped closure which fastens two ends together through a screw, box or hook-insert mechanism.

A box clasp is another form of closure that uses a tab or insert that is inserted into a decorative box. A fishhook clasp is another form of clasp that has a hook designed to be inserted into an oval shaped casing and can be used for lighter weight jewelry. This is similar to a basic hook clasp that simply has a curved piece for catching onto a loop or circle on the opposing side of jewelry.

Other types of bracelet or necklace clasps include the lobster clasp which resembles a pinching style lobster claw that is spring loaded to clamp onto an opposing loop. Another spring-loaded closure is the push button clasp that clicks into place when an opposing stem or ball joint is inserted into a spring clasp, later released by pressing the button. A swivel clasp is another form of closure that is the same as lobster clasp but with a 360° swivel. There is also the basic springing clasp which is a loop with a spring-loaded slide that is retracted to allow an opposing hoop to connect.

Another type of clasp used on certain types of material bracelets, like leather bracelets is a buckle clasp which is essentially the same a belt buckle. A concealed clasp is another rarer form of jewelry closure that is hidden within a design but otherwise functions the same as other clasps functionally, for example, a hidden box clasp. Another less common closure is the ladder clasp which has what appears as a two-spoke ladder, that is folded over against an opposing side with a notch that can be fit into one of the spokes of the ladder for an adjustably sized fit.

Again, other closure types for bracelets and necklaces can include slide clasps, with two bars that slide into a locked position with one another. Magnetic clasps are very basic and simply connect with two opposing magnets. A toggle clasp is a two-piece closure in the form of a bar on one side and a hoop on the other. The bar is angled and passed lengthwise through the hoop and then arranged in a wide manner so as not to be able to pass back through the same hoop to complete the connection.

However, despite these numerous types of closures for both earrings as well as necklaces and bracelets, they all tend to suffer from at least one of three different drawbacks, and occasionally two or even all three.

Because jewelry tends to be small, the closures are even smaller. Many people, particularly the elderly and those with arthritis or poor vision, have great difficulty in manipulating the small parts needed to open the closures, make the connection, and then close the closure. See for example the basic spring clasp which requires manipulation of a small spring and threading a small eyelet over an open hoop.

Another major drawback to the prior art closures is that many of the designs simply don't hold very well or do not lock at all which can lead to lost jewelry. See for example the basic push-back earing closures or the fish-hook style stems.

Another drawback with prior art closures is that some of the more secure closures tend to be complicated to construct and include parts that can wear out over time. This is particularly true of all spring-loaded closures because the spring can either wear out over time because it is usually very small, and also such springs can become displaced making the closure inoperative.

OBJECTS AND SUMMARY

The present arrangement looks to overcome the drawbacks associated with the prior art and provide a jewelry closure that can be used on both earrings as well as bracelets and necklaces, and possibly other forms of jewelry that is constructed in a way to make it easy to open and close, manufactured in a sturdy yet relatively less complicated manner, and further provides a secure connection with no chance of losing the jewelry item or parts of the closure.

Such an arrangement includes a stem with a notch on a first side of the jewelry item. On the other side a ball joint is provided. A collar is disposed over the ball joint, with the ball joint exposed on the other side. A rotatable connection element is pressed against the collar and snap locks onto the ball joint in a manner securing both the collar and the rotatable connection element to the other side of the jewelry item. Inside the rotatable connection element are two parallel catches with a space in between them for receiving the notched stem.

To close the closure, the notched stem is placed into the rotatable connection element with the stem passing through the two parallel catches inside. Then the wearer locks the closure by rotating the rotatable connection element. In doing so the two parallel catches engage the notch on the stem and prevent the closure from opening. To open the closure, the rotatable connection element in the opposite direction, re-orienting the parallel catches to release the notch on the stem, allowing the stem to be removed, opening the closure.

To this end a jewelry item and closure is provided having a first side of the jewelry item with a stem and locking notch and a second side of the jewelry item having a mounting stem and ball.

The closure has a collar with a hollow cavity for fitting over the mounting stem and said ball. A rotatable connection element connects with the ball of the second side of the jewelry item, affixing the collar and the rotatable connection element with the second side of the jewelry.

In an open configuration, the stem with the locking notch of the first side of the jewelry can be inserted within a locking cavity of the rotatable connection element. In a closed configuration, the rotatable connection element is configured to be rotated to engage the locking notch of the stem, preventing removal of the stem from the rotatable connection element.

BRIEF DESCRIPTION OF THE DRAWINGS

The present invention can be best understood through the following description and accompanying drawing, wherein.

DETAILED DESCRIPTION

Figure 1A:
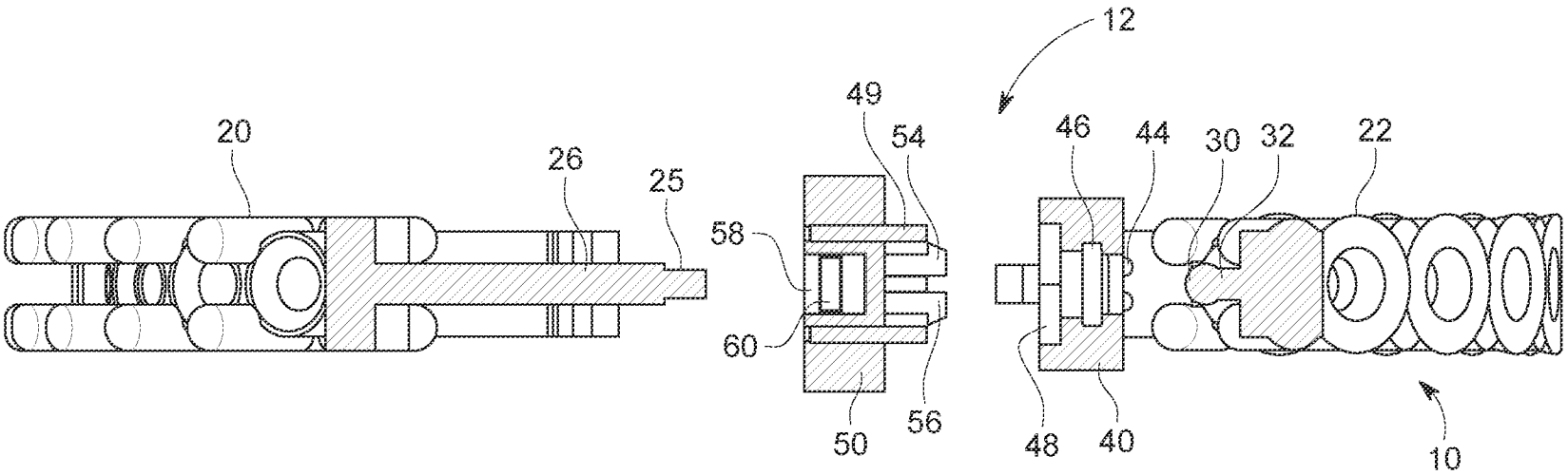
FIG. 1*a* illustrates a top view of an earring and a closure in accordance with one embodiment of the present invention.
Figure 1B:
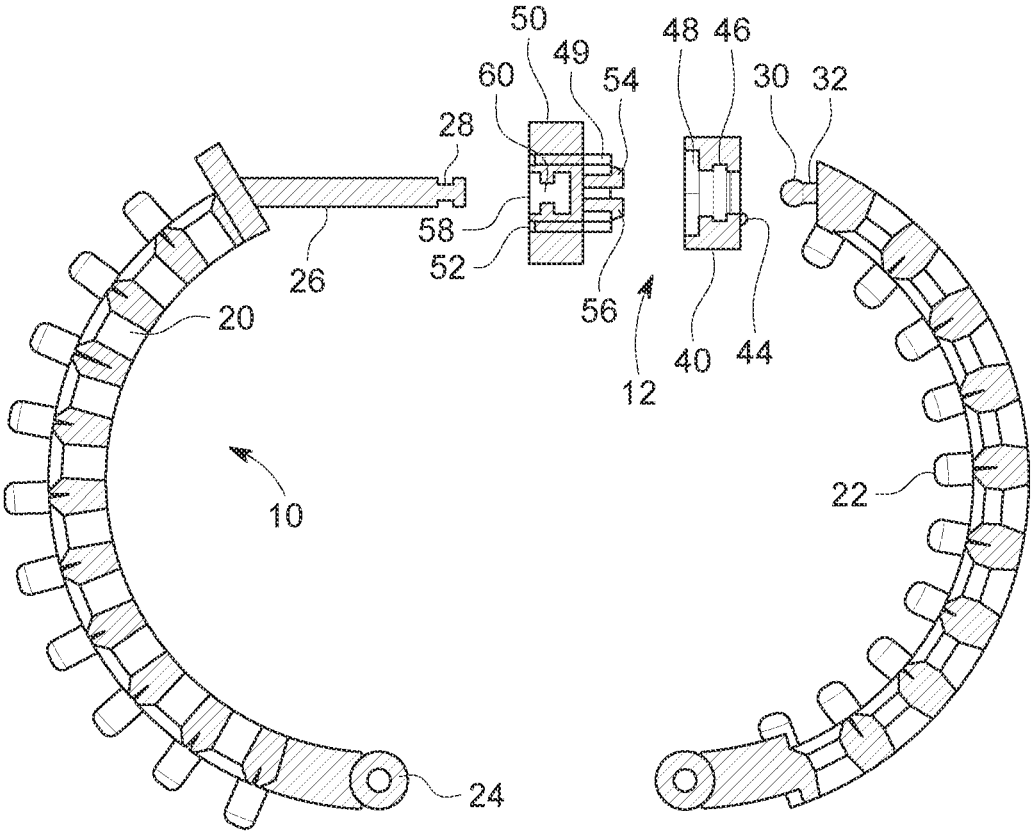
FIG. 1*b* illustrates a side view of the earring and the closure in accordance with one embodiment of the present invention.
Figure 1C:
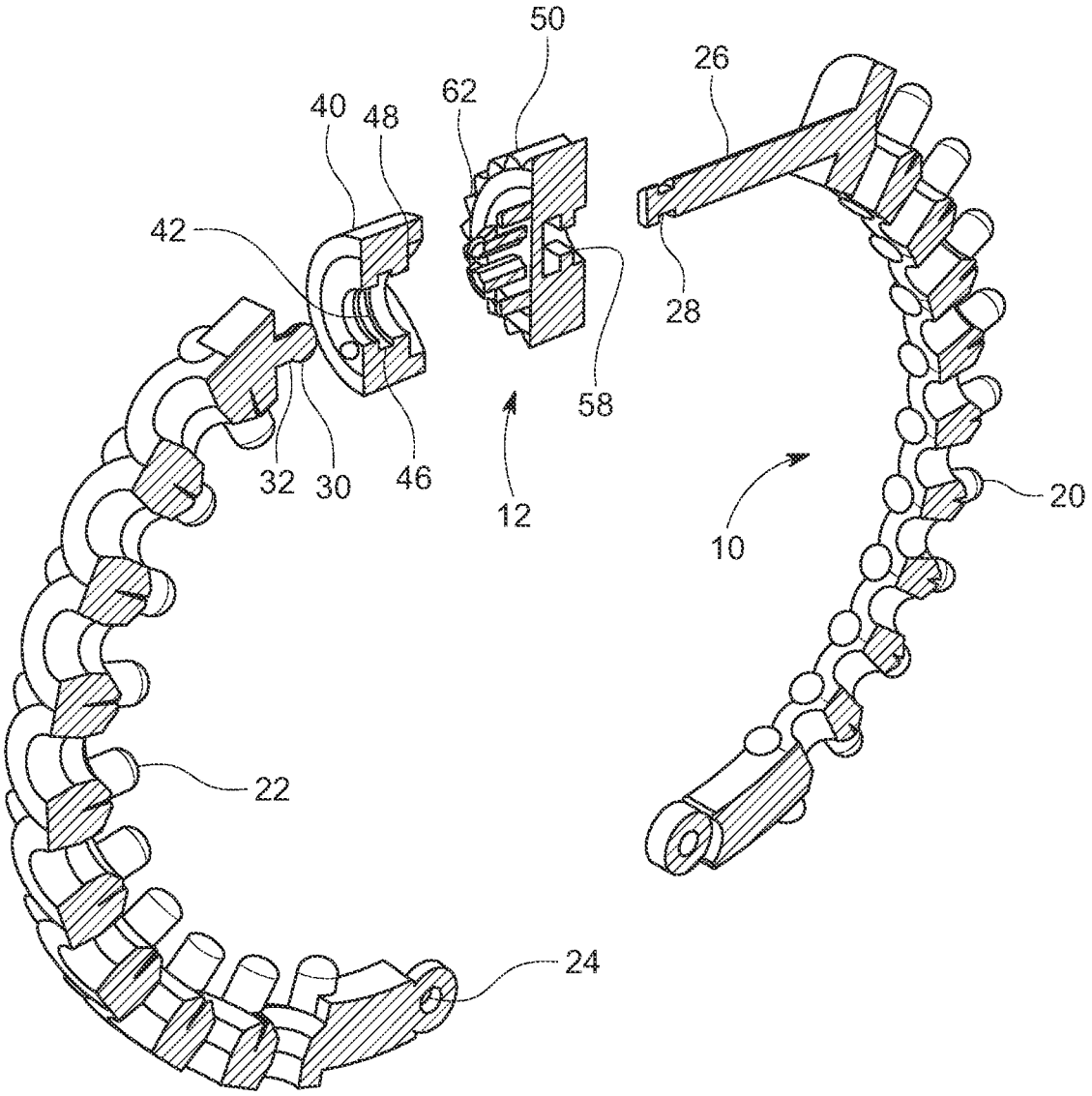
FIG. 1*c* illustrates a cut away perspective view of the earring and the closure in accordance with one embodiment of the present invention.
Figure 1D:
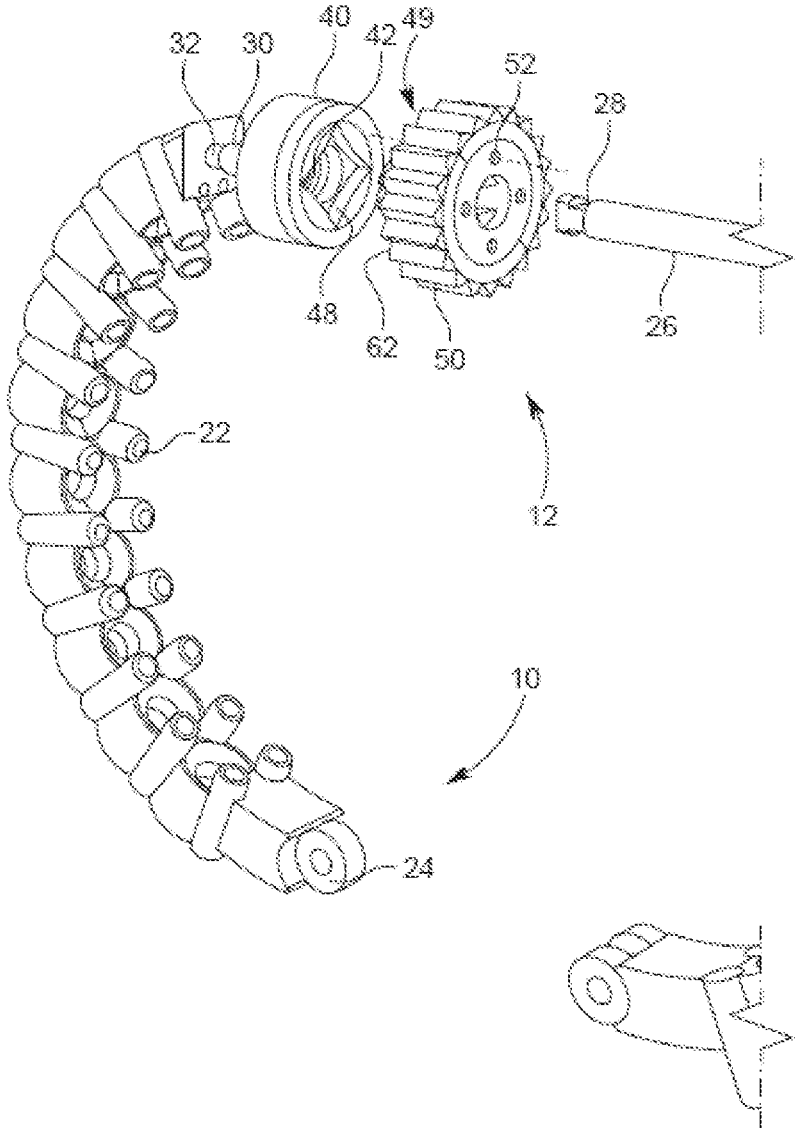
FIG. 1*d* illustrates a close up of the earring and closure from FIGS. 1*a*-1*c*, in accordance with one embodiment of the present invention.

FIGS. 1*a*-1*d* illustrate various views of an earring 10 having a closure 12 in accordance with one embodiment. It is noted that the present examples shown in these figures is for an earring, but the closure described herein may be equally applicable to different jewelry items such as necklaces or bracelets as shown for Example in FIGS. 2*a* and 2*b* (bracelet).

As shown in FIGS. 1*a*-1*d*, earring 10 has a first side 20 and a second side 22 connected at the bottom through a hinged pivot connection 24. First side 20 of earring 20 has a stem 26 that has a locking notch 28 oriented as point of reduced thickness in the form of two cut aways on opposing side of stem 26. Second side 22 of earring 10 has a ball 30 located on a short mounting stem 32.

Turning to the independent components of closure 12, a collar 40 includes a hollow cavity 42 passing entirely therethrough for allowing ball 30 and mounting stem 32 of second side 32 to pass therein. On the side surface of collar 40 facing the second side 22 of earing 10, there are two alignment knobs 44 so that collar 40 aligns correctly against and does not rotate relative to second side 22. Collar 40 also has a recess 46 located approximately in the middle of hollow cavity 42 and extending around the entire inner circumference of cavity 42, the function of which is disclosed in more detail below. Finally, collar 40 has a square/diamond recess 48 on the side of collar 40 facing towards first side 20 of earring 10 to assist in connecting with a rotatable connection element 50 as explained in more detail below.

The other independent component of closure 12 is rotatable connection element 50. Rotatable connection element 50 has four spring/pin cavities 52 configured to receive connection springs 49 when collar 40 and rotatable connection element 50 are placed against one another as explained below. Rotatable connection element 50 also has four (4) snap connectors 54 that are deformable and configured to encapsulate ball 30 within cavity 42. For example, when rotatable connection element 50 is placed flush against collar 40, snap connectors 54 pass within cavity 42 encapsulate ball 30, affixing both rotatable connection element 50 and collar 40 to second side 22 of earing 10. As shown in FIGS. 1*a*-1*d*, each of the four (4) snap connectors 54 have a catch tab 56 that fits within recess 46 of collar 40 allowing rotatable connection element 50 to securely rotate within collar 40, but without coming disconnected from second side 22 of earing 10, allowing rotatable connection element 50 to rotate around ball joint 30. It is noted that connection springs 49 may be placed through the four spring cavities 52 and into square/diamond recess 48 of collar 40, e.g., into the points of the square, to provide a rotation limiter to rotatable connection element to approximately 90 degrees and to provide a friction feedback to the user so that they can feel when the rotatable connection element 50 has been returned enough to lock closure 12 as explained below.

On the opposing side of rotatable connection element 50 facing first side 20 of earing 10, is a locking cavity 58 having two parallel locking bars 60. Locking cavity 58 is dimensioned to receive stem 26 and locking notch 28 of first side 20 of earing 10. When rotatable connection element 50 is oriented in a first unlocked position, parallel locking bars allow stem 26 to fit fully within locking cavity 58 when first side 20 and second side 22 are pressed together via pivot connection 24. However, when rotatable connection element 50 is turned about ball 30 approximately 90 degrees to a locking position, with spring 49 and square/diamond recess 48 providing friction feedback to the user, parallel locking bars 60 rotate to catch on locking notch 28, preventing stem 26 from leaving locking cavity 58. In order to facilitate turning of rotatable connection element 50 the outer circumference has engagement ridges 62 to help grasp with the user's fingertips.

Each of the components of earing 10 and closure 12 has a set of exemplary dimensions. These dimensions are for illustration purposes only for an exemplary sized earing 10 as shown. However, it is understood that other dimensions may be used in keeping with the functions of the various components of earring 10 and closure 12. For example, stem 26 can be approximately 0.95 mm in width/diameter, with locking notch 28 having an opening width of approximately 0.60 mm. Collar 40 may have width of 3.05 mm and a thickness of about 1.35 mm. Rotatable connection element 50 is slightly larger than collar 40 and can be approximately 4.0 mm wide and approximately 1.90 mm thick. Four (4) snap connectors 54 of rotatable connection element 50 can be approximately 1.75 mm wide to fit within cavity 42 of collar 40. On the other side of rotatable connection element 50, parallel locking bars 60 within locking cavity 58 can be about 0.48 mm wide to engage/disengage with locking notch 28. The depth of locking cavity 58 can extend an additional 0.60 mm beyond locking bars 60 to accept the remainder of stem 26 that extends beyond locking notch 28.

Figure 2A:
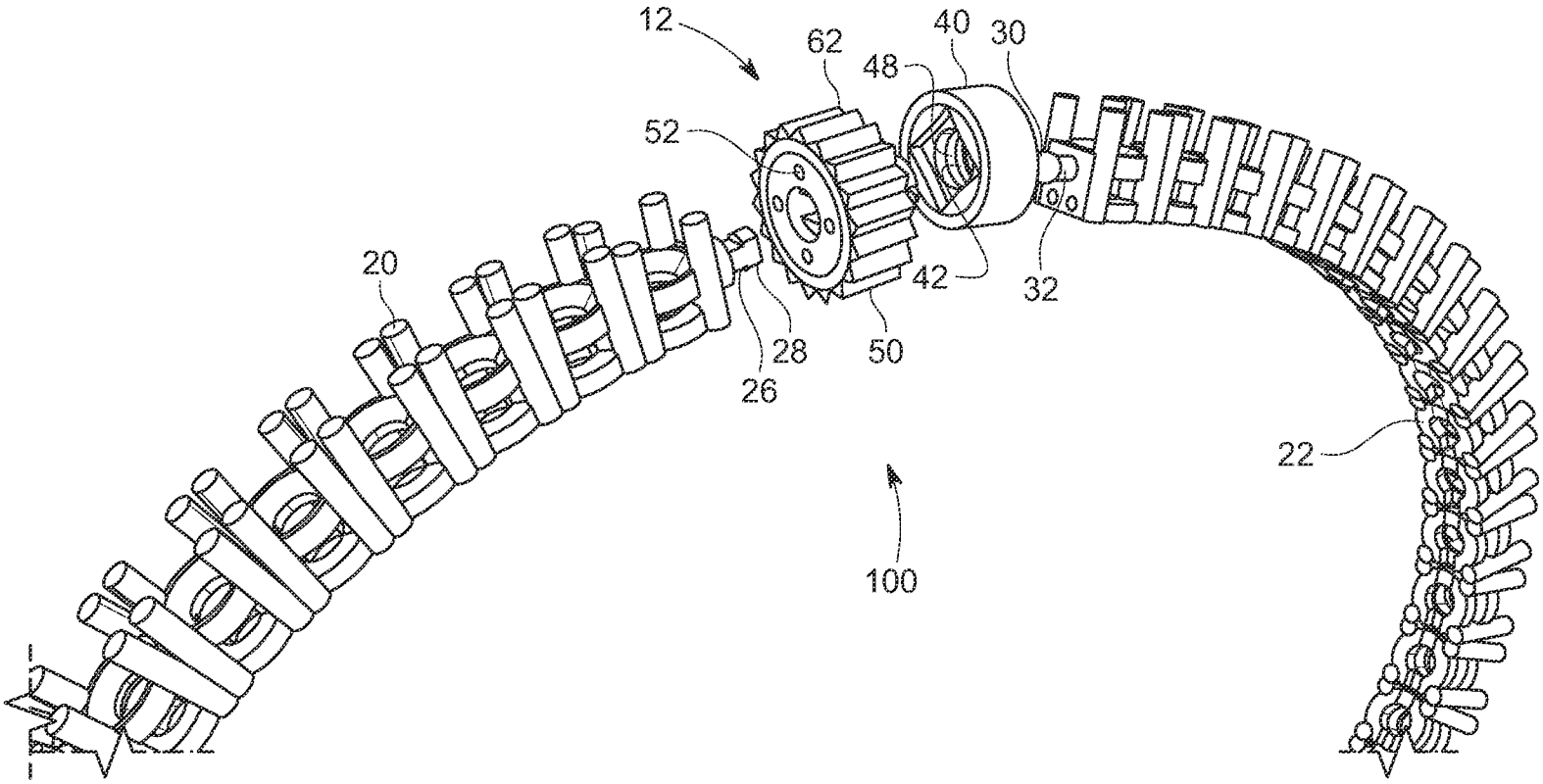
FIGS. 2*a* and 2*b* illustrates the closure from FIGS. 1*a*-1*c* in use on a bracelet, in accordance with one embodiment of the present invention.
Figure 2B:
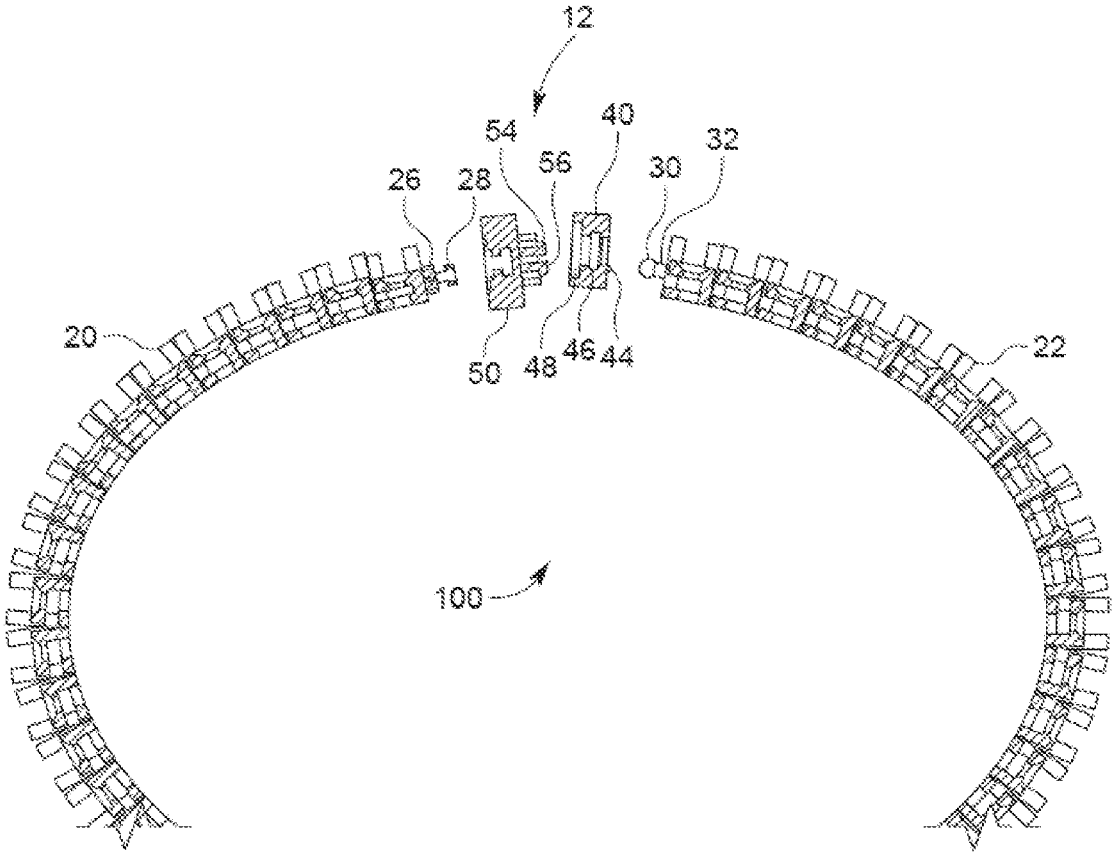

In another embodiment shown in FIGS. 2*a* and 2*b*, a bracelet 100 is shown using the same closure 12 as described above in FIGS. 1*a*-1*d*, with all the same components and functions. A similar closure 12 may also be used for other jewelry items such as necklace or other applicable jewelry items.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A jewelry item comprising:

a first side including a first and second end, said first end having a stem and locking notch;

a second side including a third and fourth end, said third end having a mounting stem and ball joint, and said second end of said first side is connected to said fourth end of said second side; and a closure having a collar rotatably connected to a rotatable connection element;

wherein said collar being connected to said third end and located between said third end and said rotatable connection element; and wherein, in an open configuration, said stem with said locking notch of said first side can be inserted within a locking cavity of said rotatable connection element, and wherein in a closed configuration, said rotatable connection element is configured to be rotated to engage said locking notch of said stem, preventing removal of said stem from said rotatable connection element.

2. The jewelry item as claimed in claim 1, wherein said collar has two alignment nobs facing said third end of said second side.

3. The jewelry item as claimed in claim 1, wherein said collar has a recess located approximately in the middle of a hollow cavity, configured to accept said rotatable connection element.

4. The jewelry item as claimed in claim 3, wherein said rotatable connection element has a plurality of deformable snap connectors that fit within said cavity of said collar to connect with a ball on said third end of said second side of said jewelry item.

5. The jewelry item as claimed in claim 4, wherein said rotatable connection element has four deformable snap connectors.

6. The jewelry item as claimed in claim 4, wherein each of said plurality of deformable snap connectors has a catch tab for engaging within said recess of said collar, such that said rotatable connection element is simultaneously connected to said ball of said third end of said second side of said jewelry item, and rotatable relative to said collar.

7. The jewelry item and closure as claimed in claim 1, wherein said collar has a square/diamond recess on a side facing said first end of said first side and said rotatable connection element.

8. The jewelry item and closure as claimed in claim 7, wherein said rotatable connection element has a plurality of spring cavities configured to receive connection springs that pass therethrough and into said square/diamond recess of said collar providing a rotation limiter to rotatable connection element, relative to said collar of approximately 90 degrees.

* * * * *